US006543322B2

(12) United States Patent
Skoko

(10) Patent No.: US 6,543,322 B2
(45) Date of Patent: Apr. 8, 2003

(54) BAGEL CUTTER

(76) Inventor: John M. Skoko, 121 Dochan Cir., Montebello, CA (US) 90640

( * ) Notice: Subject to any disclaimer, the term of this patent is extended or adjusted under 35 U.S.C. 154(b) by 0 days.

(21) Appl. No.: 09/923,901

(22) Filed: Aug. 6, 2001

(65) Prior Publication Data

US 2002/0020260 A1 Feb. 21, 2002

Related U.S. Application Data

(60) Provisional application No. 60/223,988, filed on Aug. 9, 2000.

(51) Int. Cl.[7] ..... B26D 7/00; B26D 3/30

(52) U.S. Cl. ..... 83/13; 83/762; 83/454; 83/465; 83/870; 83/932; 269/87.2; 269/288; 269/295; 7/673; 7/385

(58) Field of Search ..... 83/13, 761, 762, 83/454, 465, 466.1, 467.1, 932, 870, 455, 745; 30/114, 289; 16/225, 226, 255, 277, 288; 269/287, 288, 291, 292, 295, 87.2, 265, 268, 269, 270; D7/672–677, 381, 385

(56) References Cited

U.S. PATENT DOCUMENTS

| | | | | | |
|---|---|---|---|---|---|
| 194,417 | A | * | 8/1877 | Davis | 83/762 |
| 280,796 | A | * | 7/1883 | Chapman | 83/761 |
| 1,098,941 | A | * | 6/1914 | Collins | 83/762 |
| 4,550,636 | A | * | 11/1985 | Josselson et al. | 269/295 |
| 4,589,206 | A | * | 5/1986 | Marcoux | 30/114 |
| 4,807,505 | A | * | 2/1989 | Campbell et al. | 83/454 |
| D315,275 | S | | 3/1991 | Aziz et al. | D7/673 |
| 5,228,668 | A | * | 7/1993 | Guyer | 269/270 |
| 5,481,953 | A | * | 1/1996 | McLeod | 83/762 |
| D371,728 | S | * | 7/1996 | Krueger | D7/673 |
| D378,972 | S | | 4/1997 | Hug et al. | D7/381 |
| 5,718,158 | A | * | 2/1998 | Rogge | 83/762 |
| 5,724,877 | A | * | 3/1998 | Kensrue | 83/870 |
| 5,819,629 | A | * | 10/1998 | Sarich | 83/745 |
| 5,946,998 | A | * | 9/1999 | Thompson | 269/270 |
| 6,128,996 | A | * | 10/2000 | Sato et al. | 73/765 |

* cited by examiner

*Primary Examiner*—Boyer D. Ashley
(74) *Attorney, Agent, or Firm*—Edgar W. Averill, Jr.

(57) ABSTRACT

A cutting frame for holding an object to be sliced into two pieces. The object, such as a bagel, has a bottom surface, a peripheral edge, and a top surface. The cutting frame has a base which holds a support stem, which in turn holds a ring shaped guide member. The guide member has a knife blade guide slot extending through it to guide a knife downwardly through the guide member and through a bagel or other object held in the guide member. The process of using the cutting frame includes holding a bagel against a closed side of the compartment formed within the guide member so that the user's fingers press the bagel against the closed surface of the compartment. A knife is then placed in the knife blade guide slot and drawn back and forth downwardly through the bagel to form an accurate slice parallel to the bottom of the bagel. The guide blade knife slot extends completely through the guide member so that the bagel is always cut into two separate pieces.

9 Claims, 3 Drawing Sheets

BAGEL CUTTER

CROSS-REFERENCE TO PROVISIONAL PATENT APPLICATION

This application claims the benefit of U.S. provisional application No. 60/223,988, filed Aug. 9, 2000.

BACKGROUND OF THE INVENTION

The field of the invention is kitchen appliances and the invention relates more particularly to slicing guides for slicing bagels, rolls and other baked goods or other foodstuffs. Bagels are most commonly sliced by placing the bottom of the bagel on a counter top or bread board. Next, a knife is oriented so that its blade is parallel to the counter top or bread board surface and while the bagel is being held by the user's palm against the counter, the knife is drawn back and forth parallel to the support surface to cut the bagel in two. Several problems arise from this commonly used practice. First, the cut is often not parallel to the bottom of the bagel since it is a somewhat awkward movement. Secondly, there is a safety hazard in that the user's fingers can extend below the cut line. Alternatively, the bagel can be held so that its bottom is oriented vertically and the knife drawn back and forth in a downward directly. Once again, the position of the cut is often not accurate and secondly, the same safety hazard exists.

Several bagel cutters have been devised. Once such bagel cutter is shown in U.S. design Pat. No. 371,728, which utilizes a plurality of vertical pegs to hold a bagel and also two pairs of closely spaced pegs to guide a knife along a vertical path through the bagel. A bagel cutter using a guillotine style of blade is shown in U.S. design Pat. No. 315,275 where a bagel is placed between two vertical plates.

An electrical cutter is shown in U.S. design Pat. No. 378,972 where the bagel is placed in a compartment and an oscillating knife passes horizontally through the bagel once the door of the device is closed. All of these devices have shortcomings, either in the space required to store the device, the aesthetic appearance of the device, or the expense of fabricating the device. There is, thus, a need for an inexpensive, and yet attractive and compact, bagel cutter which is easy to use.

BRIEF SUMMARY OF THE INVENTION

The present invention is for a cutting frame for holding an object such as a bagel to be sliced into two pieces. The frame has a base for holding a guide member and a support step is held by the base supporting a guide member which has a peripheral object support band. The peripheral object support band surrounds at least a majority of the peripheral edge of the object to be sliced which forms an object supporting compartment. The object supporting compartment has an open side and an objecting supporting side which contacts the bottom surface of the object to be sliced. The peripheral object support band includes a knife blade guide slot formed through the entire extent of the peripheral object support band. The knife blade guide slot extends into the support stem. Means are provided for preventing the object to be sliced from passing the object supporting side. Preferably, the object support band completely surrounds the entire peripheral edge of the object to be sliced. Furthermore, the device is especially useful for slicing bagels, in which case the guide member is circular in shape. The present invention is also for the process of using the guide member which includes the steps of inserting a bagel or other object having a bottom surface, a peripheral edge, and a top surface into a bagel support compartment of a bagel cutting frame. The bagel is held against the bagel support side of the compartment by pressing the user's fingers against the top of the bagel and the user's thumb against the bagel support side. A knife is grasped and its blade is guided into the knife blade guide. It is then drawn back and forth and pressed downwardly to cut through the bagel as the knife is guided by the support slot. Since the support slot extends into the stem, the bagel is completely sliced in two when the process is complete.

DESCRIPTION OF THE PREFERRED EMBODIMENTS

Figure 1:
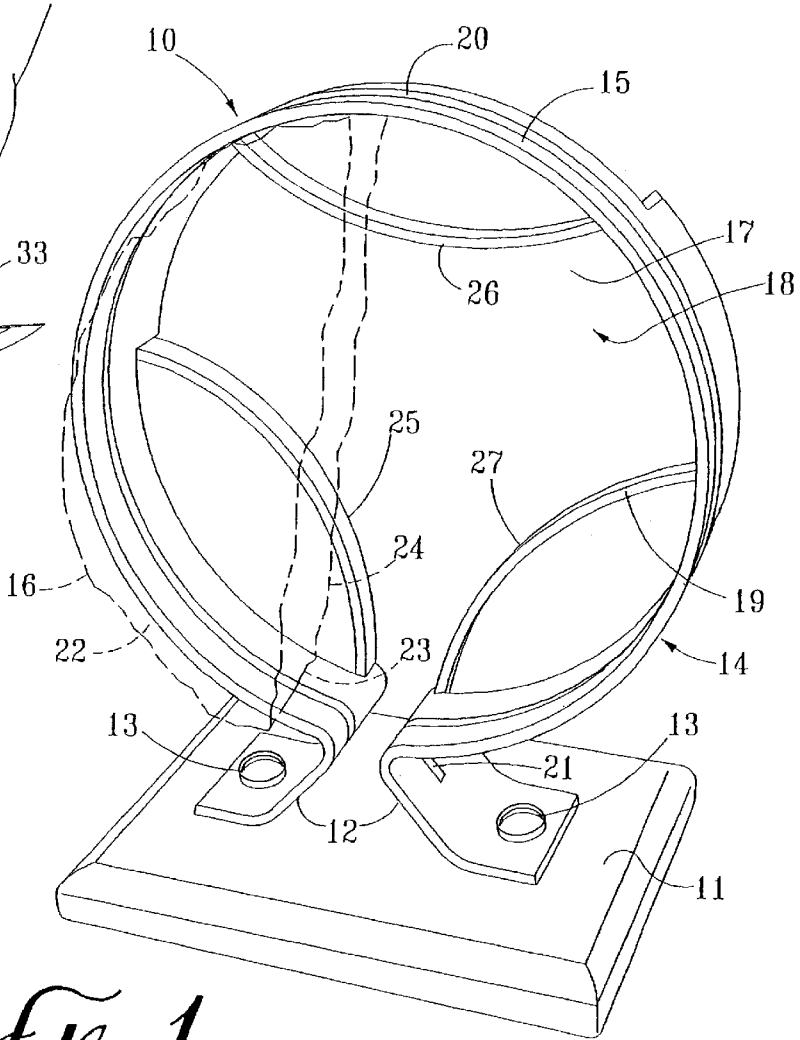
FIG. 1 is a perspective view of the cutting frame of the present invention.

The cutting frame of the present invention is shown in perspective view in FIG. 1 and indicated generally by reference character 10. Cutting frame 10 has a base 11 which is typically used by being placed on a counter top or bread board. Base 11 holds a support stem 12 by two screws 13. Base 11 may, of course, may be integrally molded with support stem 12 wherein the screws 13 are not needed.

Support stem 12 supports a guide member 14 which includes a peripheral object supporting band 15. Band 15, as shown in FIG. 1, is circular, which is preferred for supporting a bagel, such as bagel 16 shown in a cut-a-way view in FIG. 1. The peripheral object support band 15 defines the edge of an object supporting compartment 17 which has an open side 18 and an object supporting side 19. A knife blade guide slot 20 is formed through peripheral object support band 15 and extends into support stem 12 as indicated by reference character 21. In this way, a knife will pass completely through bagel 16 and not leave a small hinge at the bottom which often occurs when a bagel is cut on a bread board.

Bagel 16 has a top surface 22, a peripheral edge 23, and a bottom surface 24. Bottom surface 24 rests against one of three stop bars 25, 26, and 27, which cause object supporting side 19 to hold the bagel in object support compartment 17 when a bagel is pressed by a user's fingers pressed against top surface 22, as shown in FIG. 4 of the drawings.

Figure 2:
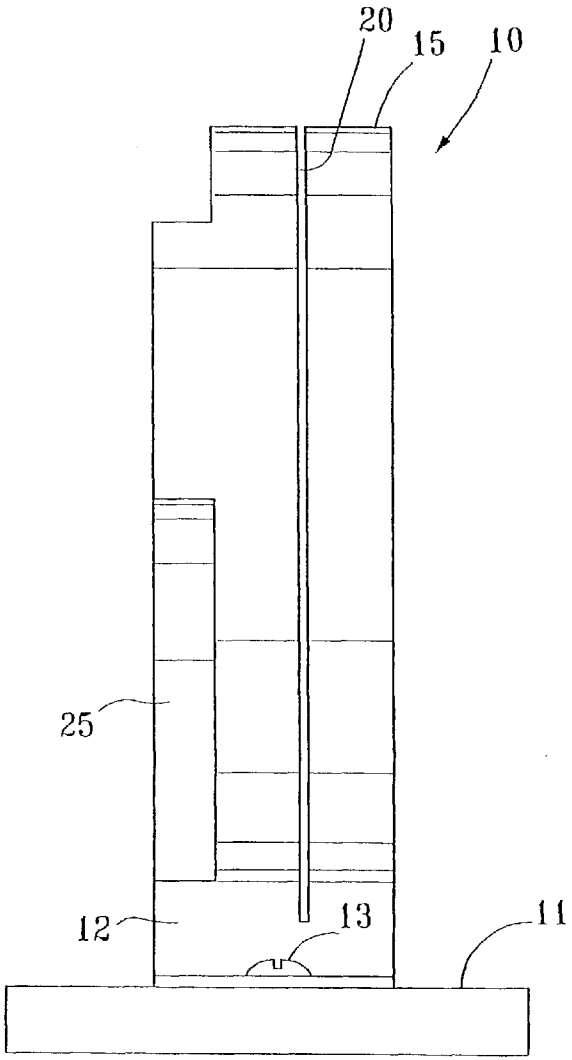
FIG. 2 is a side view thereof.
Figure 3:
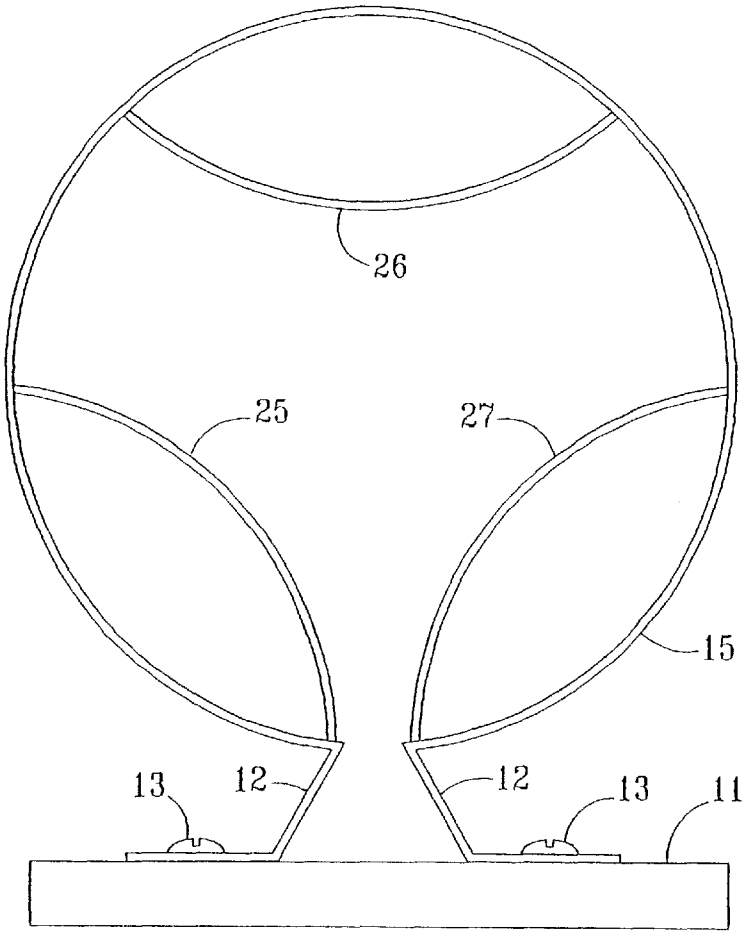
FIG. 3 is a front view thereof.

The cutting frame is shown in side view in FIG. 2 and in front view in FIG. 3.

Figure 4:
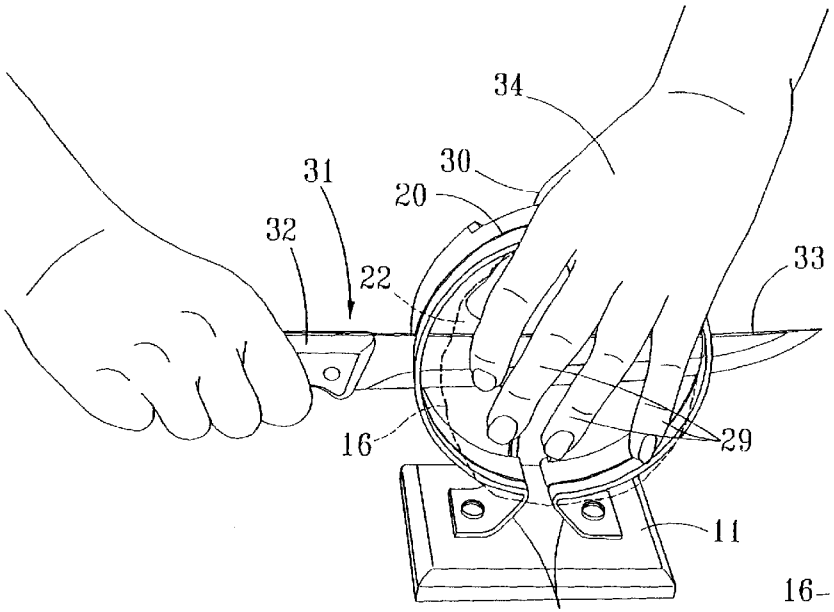
FIG. 4 is a perspective view showing a bagel being sliced while being held by the user.

The process of using the cutting frame of the present invention is shown best in FIG. 4. There a user's left hand is shown with its fingers 29 pressing against the top surface 22 of bagel 16. Bagel 16 is being pressed so that its bottom surface (not shown) 24 presses against the stop bars 25, 26, and 27. The user's thumb 30 also presses against one or more of the stop bars to hold the cutting frame while the bagel is being cut. A knife 31 has a handle 32 and a blade 33. The user's right hand 34 holds handle 31 as blade 33 has been passed under the user's palm 34 and into the knife blade guide slot 20. As can be seen in FIG. 4, the knife can pass completely through bagel 16 and into extension 21 so that the bagel is always completely sliced in two.

The result is the easy and safe cutting of a bagel with an always accurate slice which is parallel to the bottom surface 24 of the bagel, since it is supported against the stop bars which are parallel to the knife blade knife slot 20.

Figure 5:
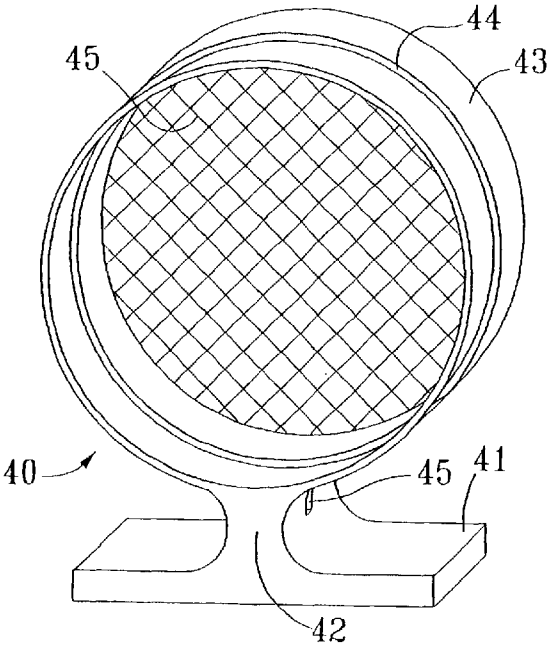
FIG. 5 is a perspective view of an alternate embodiment of the cutting frame of FIG. 1.

The cutting frame of the present invention is preferably fabricated from stainless steel, although a less expensive version may be injection molded from a polymer such as polyvinyl chloride. In this instance, as shown in FIG. 5, the cutting frame 40 has a base 41, which is integral with support stem 42, which in turn is integral with peripheral object support band 43. The knife blade guide slot 44 extends into the support stem 42 as indicated by reference character 45. The means for holding the bottom of the bagel in the cutting frame 40 comprises a mesh 45, which is also integrally formed with the injection molded cutting frame.

Figure 6:
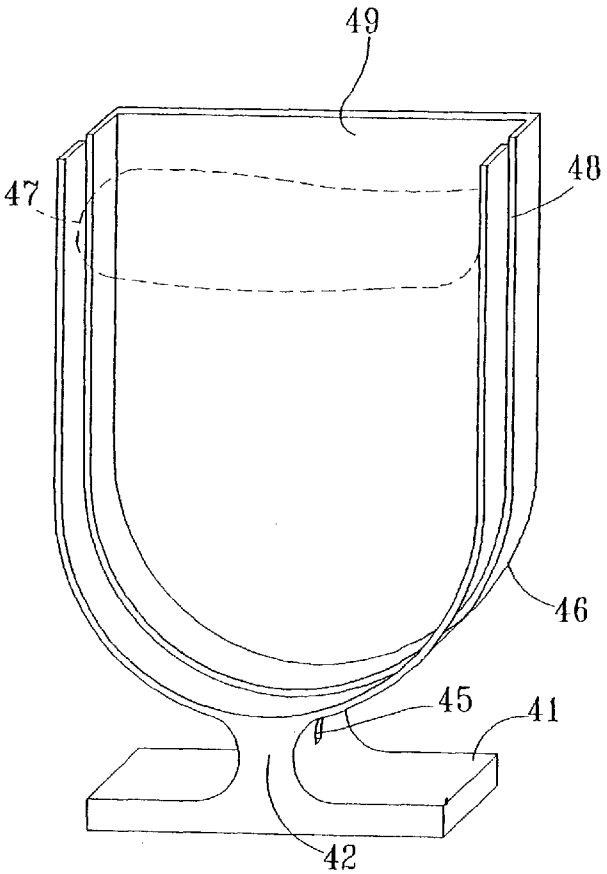
FIG. 6 is a perspective view of an alternate embodiment of the cutting frame of FIG. 1.

An alternate embodiment is shown in FIG. 6 which is also injection molded having a base 41 and a support stem 42. The peripheral object support band, rather than completely surrounding an object support compartment, is open at the top and is also non-circular in shape. In this way, a French roll may be cut, as shown in phantom view and indicated by reference character 47. This is accomplished by inserting a knife into slot 48 as the French roll 47 is pressed against a solid back 49.

Figure 7:
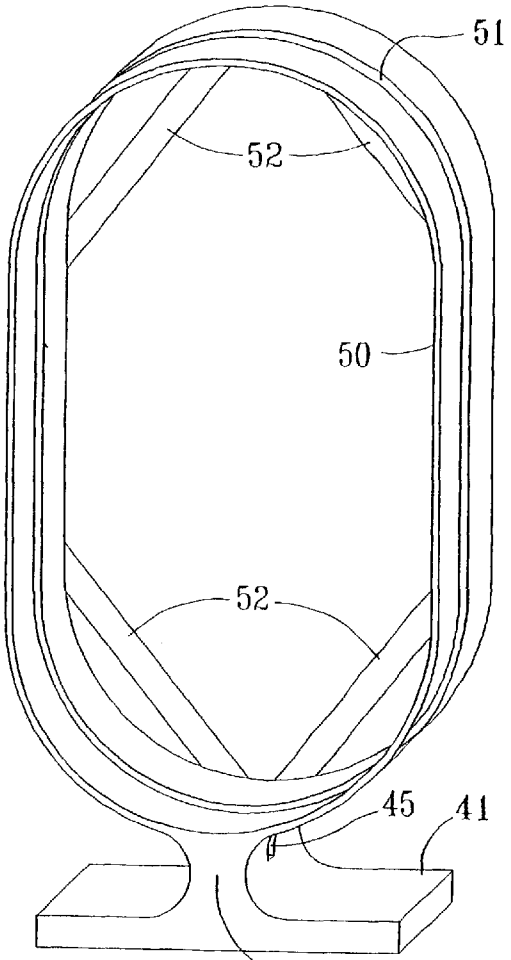
FIG. 7 is a perspective view of an alternate embodiment of the cutting frame of FIG. 1.

FIG. 7 shows yet a further alternative where a noncircular object support band is indicated by reference character 50. Band 50 has a knife guide slot 51. Four bars 52 provide means for preventing an object to be cut from passing out of the compartment in which it is held.

Thus, the device of the present invention provides an exceptionally easy to use, inexpensive to fabricate, and attractive appliance. It permits the accurate and safe slicing of baked goods, as well as other objects. It is compact and easily stored and yet, is attractive and may be maintained on a counter top.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cutting frame holding an object to be sliced into two pieces, said object to be sliced having a bottom surface, a peripheral edge and a top surface, said cutting frame comprising:

a base;

a support stem held by said base; and a guide member held by said support stem, said guide member having a peripheral object support band, said peripheral object support band surrounding at least a majority of said peripheral edge of said object to be sliced forming an object support compartment, said object support compartment having an open side which guide member has no part capable of closing said open side and an object supporting side contacting said bottom surface of said object to be sliced and said peripheral object support band including a knife blade guide slot formed through the entire extent of said peripheral object support band and said knife blade guide slot extending into said support stem and means for preventing said object to be sliced from passing through said object supporting side and said guide member contacting only the bottom and peripheral edge of the object to be sliced and leaving the top surface untouched by said guide member when an object is being sliced.

2. The cutting frame of claim 1 wherein said knife blade guide slot is vertically oriented.

3. The cutting frame of claim 1 wherein said guide member is fabricated from stainless steel.

4. The cutting frame of claim 1 wherein said peripheral object support band surrounds the entire peripheral edge of said object to be sliced.

5. The cutting frame of claim 4 wherein said peripheral object support band is circular in shape.

6. The cutting frame of claim 1 wherein said means for preventing said object to be sliced from passing through said object supporting side comprises a plurality of stop bars.

7. The cutting frame of claim 6 wherein there are three stop bars.

8. The cutting frame of claim 7 wherein said three stop bars are curved.

9. A process for slicing a bagel into two slices comprising:

inserting a bagel having a bottom surface, a peripheral edge and a top surface into a bagel support compartment of a bagel cutting frame having a peripheral bagel support band having a knife blade guide slot surrounding said bagel support compartment and said bagel support compartment having an open side and a bagel support side and said bagel being inserted so that its bottom surface abuts said bagel support side and said bagel being held by a user's fingers pressing against said top surface of said bagel and the user's thumb pressing against the bagel support side of said bagel support compartment so a palm of a user's hand extends over said peripheral support band leaving a knife blade space between the user's palm and the bagel support band;

grasping a handle of a knife by a user's other hand and guiding a blade of said knife between said user's palm and the bagel support band so that a cutting edge of said knife passes into said knife blade guide and against a peripheral edge of said bagel; and drawing the knife back and forth and downwardly while holding the user's fingers against the top of the bagel until the knife has cut the bagel into two slices.

* * * * *